US006739735B2

(12) United States Patent
Talamo et al.

(10) Patent No.: US 6,739,735 B2
(45) Date of Patent: May 25, 2004

(54) LIGHTING STRIP FOR DIRECTION AND GUIDANCE SYSTEMS

(75) Inventors: John A. Talamo, Abilene, TX (US); Robert A. Meyer, Burbank, IL (US); Thomas J. Meyer, Oak Park, IL (US); Frank J. Lawdensky, Lake Forest, IL (US); Robert Rottinghaus, Bolingbrook, IL (US)

(73) Assignee: Illuminated Guidance Systems, Inc., Itasca, IL (US)

( * ) Notice: Subject to any disclaimer, the term of this patent is extended or adjusted under 35 U.S.C. 154(b) by 0 days.

(21) Appl. No.: 09/957,973

(22) Filed: Sep. 20, 2001

(65) Prior Publication Data

US 2003/0053307 A1 Mar. 20, 2003

(51) Int. Cl.[7] ..... F21V 21/00
(52) U.S. Cl. ..... 362/249; 362/153.1; 362/219
(58) Field of Search ..... 362/153.1, 145, 362/219, 240, 249, 806, 153

(56) References Cited

U.S. PATENT DOCUMENTS 1,572,214 A 2/1926 McEwing et al.
2,920,184 A * 1/1960 Kessler ..... 362/152
4,173,035 A * 10/1979 Hoyt ..... 362/252
5,337,225 A * 8/1994 Brookman ..... 362/800
5,927,845 A * 7/1999 Gustafson et al. ..... 362/800
6,074,074 A * 6/2000 Marcus ..... 362/800
6,210,017 B1 * 4/2001 Miura et al. ..... 362/153.1
6,354,714 B1 * 3/2002 Rhodes ..... 362/153.1
6,435,697 B1 * 8/2002 Simmons et al. ..... 362/219
6,523,986 B1 * 2/2003 Hoffman ..... 362/153
6,582,100 B1 * 6/2003 Hochstein et al. ..... 362/800

* cited by examiner

*Primary Examiner*—Y. My Quach-Lee
*Assistant Examiner*—Peggy A Neils
(74) *Attorney, Agent, or Firm*—David I. Roche; Baker & McKenzie

(57) ABSTRACT

A lighting strip for use in direction and guidance systems includes an elongated insulating base upon which one or more light emitting diode strips each supporting a plurality of light emitting diodes are positioned. A terminal housing supporting operative power systems and control apparatus is coupled to one end of the lighting strip while the remaining end may be coupled to an end cap or connected to a further lighting strip to increase the array size. The light emitting diodes are encapsulated within a light transmissive material top cover to provide physical protection and seal for the light emitting diodes.

7 Claims, 5 Drawing Sheets

LIGHTING STRIP FOR DIRECTION AND GUIDANCE SYSTEMS

FIELD OF THE INVENTION

This invention relates generally to lighting and guidance systems and particularly to those utilized in flush mounting within the surfaces of roadways, airport runways, sidewalks or other similar surfaces.

BACKGROUND OF THE INVENTION

For many years, the need for convenience and safety in various human facilities and environments fostered the use of illumination to provide guidance and direction. This need is particularly critical in environments tended to remain poorly illuminated or dark as well as indoor and outdoor environments during evening and night hours. From earliest illumination systems using crude candles and gas lamps through the development of electrical lamps such as incandescent, florescent or neon and the like, the trend has been toward creating illumination apparatus which functions to provide visual direction and guidance for the observer or traveler.

With the advent of vehicular traffic such as automobile, trains and airplanes illuminated direction and guidance systems became a specialized area of activity. The object of such systems became generally focused upon providing a visual direction or guidance benefit rather than general area illumination. Thus, facilities such as airport runways and taxi ways as well as vehicular roads and trackways and railways used by trains have enjoyed increased safety and efficiency through lighted direction and guideway systems.

While the fabrication used in lighted directed guidance systems varies substantially, typically all utilize an elongated array of illumination elements such as lamps or the like supported within a strip shaped housing which is coupled to a convenient source of power. In some units, a solar power apparatus is provided to store energy during day light hours and provide illumination during night time hours. The strip shape may vary from simple elongated straight or curved elements to more complex symbols such as arrowheads or diamonds and may, in some instances, even form words or abbreviations.

With the advent of higher power output light emitting diodes (LED) the capabilities and flexibility lighting strips for use in direction and guidance systems enjoyed a dramatic improvement. Light emitting diodes are substantially more reliable and durable than previously used illumination elements such as incandescent lamps or the like. In addition, the small size and high power output of the newly developed LED's greatly facilitated the use of lighting strips which may be flush mounted within roadways, airport runways or other areas subject to vehicular traffic.

Not surprisingly, the need for effective lighting strips for direction and guidance systems has prompted practitioner's in the art to create a variety of lighting strip structures. For example, U.S. Pat. No. 5,927,845 issued to Gustafson et al. sets forth an INTEGRALLY FORMED LINEAR LIGHT STRIP WITH LIGHT EMITTING DIODES having at least one light emitting diode connected between electrical bus elements to provide illumination when the bus elements are electrically activated. An extruded plastic material completely encapsulates the bus elements and the at least one LED. The encapsulating material provides a barrier to protect the elements from damage and render the light strip impervious to moisture. A process for manufacturing the integrally formed single piece light strip using continuously fed bus elements and an extruder is also set forth.

U.S. Pat. No. 4,993,868 issued to Eigenmann sets forth a CONTINUOUS PREFABRICATED ROAD-MARKING TAPE WITH COMPOSITE STRUCTURE AND PASSIVE AND ACTIVE OPTICAL EFFECT COMPLETELY INDEPENDENT FROM OUTSIDE INVESTMENT AND EXTERNAL ENERGY SOURCE includes a continuous horizontal road-marking tape which supports Light Emitting Diodes or high intensity micro lamps, solar cells and retroreflecting elements. The light emitting diodes may be focused and grouped in pairs for better visibility. The road-marking tape balances the solar energy captured by its solar cells with the emitted light employed to signal or worn motorist.

U.S. Pat. No. 5,425,595 issued to Roper sets forth a POP-UP TRAFFIC CONTROL DEVICE which is supported within a roadway or pavement surface and which includes apparatus for extending the control device above the surrounding pavement surface or withdrawing the device to a generally flush position. The device includes a movable carrier within a housing supported by a lead screw and follower. The rotation of the lead screw provides vertical movement of the pop-up device.

U.S. Pat. No. 5,450,300 issued to Rector, Jr. sets forth a LIGHTING DEVICE for providing light along a runway or taxiway at an airport. A base receptacle is adapted to be positioned along the runway and defines an open end. A sleeve member is movably received within the base receptacle and a replaceable light fixture and connecting apparatus is supported within the sleeve member. The movement of the sleeve member provides corresponding vertical movement of the light apparatus.

U.S. Pat. No. 5,453,663 issued to Nakayama sets forth a LIGHTING APPARATUS WITH AUTO-RECHARGING having a secondary battery, at least two light emitters connected in parallel, and first and second switches. When the first switches are on and the second switches are off, the light emitters are connected in parallel with each other and in series with the secondary battery. When the first switches are off and the second switches are on, the light emitters and secondary battery are connected in series.

U.S. Pat. No. 5,669,691 issued to Barrow sets forth an AIRPORT RUNWAY OR TAXIWAY LIGHT FIXTURE fabricated for flush mounting within the runway or taxiway pavement. An optical prism is detachably mounted in a cavity formed in the device cover and beneath the windows of the device. The prism has three sides forming an equilateral triangle with two of the sides sloping upwardly to an upper edge. A special sealing member fits over the prism and preferably covers one of the two sides which slope upwardly. This member extends about a lower portion of the prism and forms a water tight seal. An electric light is mounted in a bottom receptacle which supports the cover and window. A light channel is formed in the top of the cover and extends from each window towards an edge of the cover.

U.S. Pat. No. 5,839,816 issued to Varga et al. sets forth a ROAD MARKER for use either flush with or preferably slightly below the surface of a road. The road marker includes recharging batteries which are solar operated together with light emitting diodes. During darker night conditions, the solar batteries provide energy sources for the light emitting diodes.

U.S. Pat. No. 5,984,570 issued to Parashar sets forth a SELF ENERGIZED AUTOMATIC SURFACE MARKER having a housing and filler to support and protect a solar powered energy storage system. The circuitry draws power from the solar cells and stores energy in a plurality of storage capacitors. When ambient light dims, the circuitry operates a timing device which causes one or more light emitting diodes to blink and provide directed light toward approaching traffic. The top of the housing protects the solar cell while facilitating its reception of solar energy. The duty cycle may be adjusted to levels consistent with sunlight and operating time.

British Patent 965,583 issued to Greenhalgh sets forth IMPROVEMENTS IN REFLECTOR DEVICES FOR ROADWAYS OR LIKE SURFACES. a similar British Patent 1,018,831 also issued to Greenhalgh sets forth IMPROVEMENTS IN REFLECTOR DEVICES FOR ROADWAYS both of which utilize similar generally cylindrical housings received within appropriate recesses formed in roadway surfaces. The housings further support an upwardly extending member which includes one or more reflectors.

European Patent Application EP0323682A1 sets forth MODULAR FLOOR COVERING UNITS WITH BUILT IN LIGHTING used for guiding the occupants of a building along a path of travel within the building. The modular floor comprises carpet tiles which are supported in abutting arrangement to cover the structure floor. Some of the tiles include signal units having a light transmissive molded plastic housing positioned within an opening formed in the tiles. Light emitting diodes are supported within the housing and are energized by an electrical cable to provide a visually discernible pathway on the floor.

European Patent Application EP0562702A1 sets forth lighting elements which form a geometric structure within a floor surface.

European Patent Application EP0658655A1 sets forth an illumination device having at least one light emitting diode partially embedded in a solid translucent material. The translucent material includes particles which are capable of deffracting light and a cohesive element. The device may be used in road marking or similar environments.

While the foregoing described prior art devices have in varying extents improved the art and have in some instances enjoyed commercial success, there remains nonetheless a continuing need in the art for ever more effect, reliable and improved lighting strips for direction and guidance systems.

SUMMARY OF THE INVENTION

Accordingly, it is a general object of the present invention to provide an improved light strip for direction and guidance systems. It is a more particular object of the present invention to provide an improved lighting strip for direction and guidance systems which may be flush mounted within pavement areas of vehicular traffic such as roadways, airport runways and taxiways, and areas of pedestrian foot traffic. It is a further object of the present invention to provide an improved lighting strip for direction and guidance systems which is integrally strong enough to support the wear and impact of vehicle traffic thereacross or thereupon as well as foot traffic of pedestrians.

In accordance with the present invention there is provided a lighting strip for direction and guidance systems, the lighting strip comprising: an elongated base formed of an insulating material and defining first and second ends, opposed sides and an upper surface; at least one elongated strip supported upon the upper surface; a first plurality of light emitting diodes supported on the at least one elongated strip; means for energizing the light emitting diodes supported at the first end; a top cover formed of a light transmissive material encapsulating the upper surface, the elongated strip and the first plurality of light emitting diodes; and a light reflective surface formed on the upper surface, the light emitting diodes producing visible light some of which travels outwardly through the top cover after being reflected from the light reflective surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
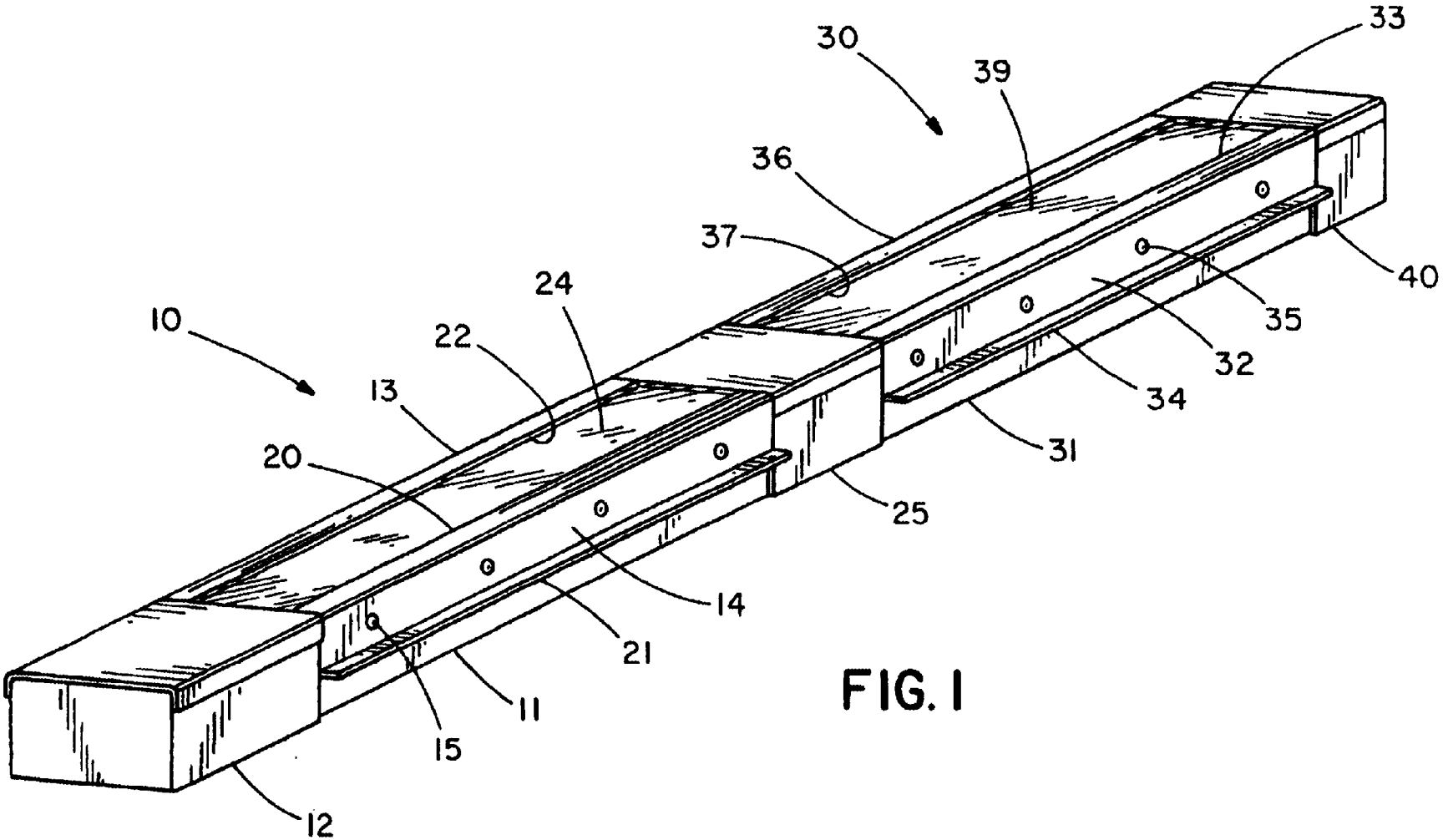
FIG. 1 sets forth a perspective view of a pair of lighting strips for direction and guidance systems constructed in accordance with the present invention.

FIG. 1 sets forth a perspective view of a pair of lighting strips constructed in accordance with the present invention and generally referenced by numerals 10 and 30. Lighting strips 10 and 30 are fabricated in substantially identical manners and are joined by a junction housing 25. In addition, lighting strip 10 is coupled to a terminal housing 12 while lighting strip 30 is coupled to an end cap 40. The structure of junction housing 25 is set forth below in FIG. 5 in greater detail. However, suffice it to note here that junction housing 25 provides coupling between a pair of lighting strips such as lighting strips 10 and 30. Terminal housing 12 is fabricated in the manner set forth below in FIG. 6. However, suffice it to note here that terminal housing 12 provides operative power and control for the pluralities of light emitting diodes (LED) supported within lighting strips 10 and 30 in the manner set forth below.

More specifically, lighting strip 10 includes an insulative base 11 formed of a nonconducting material such as plastic or synthetic wood and comprises a generally rectangular elongated member. Base 11 extends between terminal housing 12 and junction housing 25 and supports a pair of retaining straps 13 and 14. As is better seen below in FIG.

4, retaining straps 13 and 14 are secured to base 11 by a plurality of conventional fasteners 15 and 26. Retaining straps 13 and 14 are generally mirror images of each other. Strap 14 includes an outwardly extending flange 21 and an inwardly extending lip 20. Similarly, strap 13 includes an inwardly extending lip 22 and an outwardly extending flange 23 (seen in FIG. 4). In further accordance with the present invention, a top cover 24 is formed beneath straps 13 and 14 and is secured upon the upper surface of base 11. In the manner better seen in FIG. 4, top cover 24 is formed of a light transmissive encapsulating material which is deposited upon the captive light emitting diodes forming the light elements of lighting strip 10. Suffice it to note here that the plurality of light emitting diodes supported beneath top cover 24 and energized by operative apparatus within terminal housing 12 cooperate to provide an elongated light strip for direction and guidance systems.

As mentioned, lighting strip 30 is substantially identical to lighting strip 10 and thus includes an elongated generally rectangular base 31 formed of a nonconductive insulating material. Lighting strip 30 further supports a plurality of light emitting diodes in the manner set forth below in FIGS. 3 and 4. Lighting strip 30 further includes a pair of retaining straps 32 and 36. Straps 32 and 36 are substantially identical to straps 14 and 13 formed on lighting strip 10. Thus, for example, strap 32 defines an inwardly extending lip 33 and an outwardly extending flange 34. Strap 32 is secured to base 31 by a plurality of conventional fasteners 35. Similarly, strap 36 includes an inwardly extending lip 37 and an outwardly extending flange 38 (seen in FIG. 3). While not seen in FIG. 1, it will be understood that a plurality of fasteners functioning in the same manner as fasteners 35 secure strap 36 to base 31. Finally, an end cap 40 which comprises a simple protective closed end housing is received upon lighting strip 30 to provide closure of the end portion of the lighting strip.

In the preferred fabrication of the present invention, one or more lighting strips such as lighting strips 10 and 30 may be serially coupled to provide the desired length of combined lighting strip for the system. It will be understood that the present invention lighting strips may function singularly or in multiple arrays in which a plurality of strips are coupled together. In the example of FIG. 1, a pair of lighting strips are serially couple. By way of further example, FIGS. 2 and 3 set forth the serial combination of a trio of the present invention lighting strips. It will be understood however, that the present invention is by no means limited to combinations of a single, double or trio of serially combined lighting strips. On the contrary, a virtually endless variety of serially and parallel combinations may be utilized without departing from the spirit and scope of the present invention. By way of further variation, it will be noted that the embodiment set forth below in FIGS. 2 through 6 utilize a pair of rows of light emitting diodes for illumination. However, it will be equally apparent by examining FIGS. 7 and 8 and the discussion set forth below that the number of light emitting diode rows which may be utilized in the present invention lighting strip is subject to substantial variation. Thus, it will be noted that FIG. 7 shows and embodiment of the present invention in which a single light emitting diode strip is used while FIG. 8 sets forth a further embodiment in which a trio of strips of light emitting diodes is used. It will be apparent to those skilled in the art that a substantial variation of the arrangement of light emitting diodes within the present invention lighting strips is obtainable without departing from the spirit and scope of the present invention.

In the intended or anticipated embodiment of the present invention, the lighting strips are coupled together in the desired combination and thereafter fitted within grooves formed in the supporting pavement material. As mentioned above, this pavement material may, for example, comprise runways or taxiways of airport facilities or alternatively other pavement type environments such as roadways, railway stations, theaters, public buildings or the like. Of importance with respect to the present invention is the provision of a high strength lighting strip which is readily able to resist moisture when properly installed and which is able to protect the light emitting diodes from impact as traffic moves upon or across the embedded lighting strips.

Figure 2:
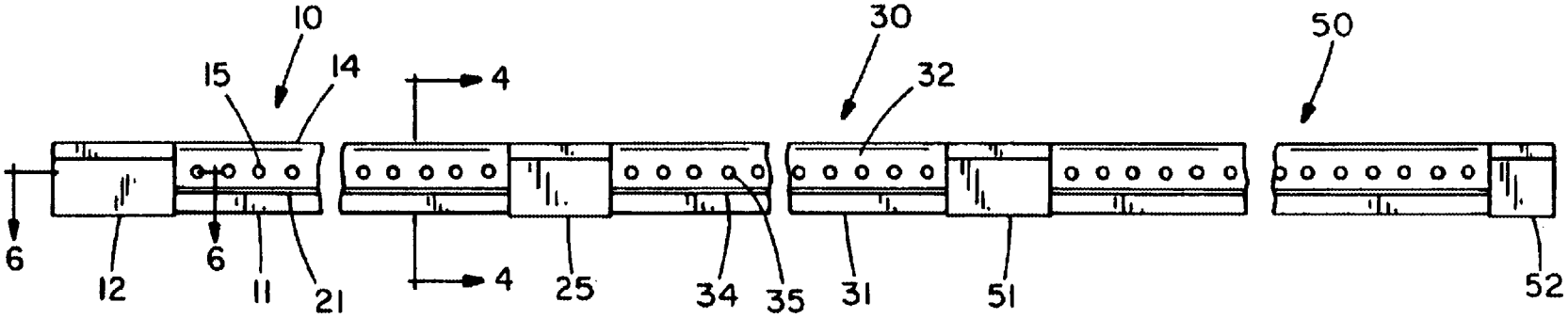
FIG. 2 sets forth a side view of a further plurality of lighting strips for direction and guidance systems constructed in accordance with the present invention.

FIG. 2 sets forth a side elevation view of a plurality of lighting strips constructed in accordance with the present invention and generally referenced by numerals 10, 30 and 50. Lighting strips 10 and 30 are set forth above in FIG. 1 and as mentioned therein are joined by a junction housing 25. In the application of the present invention lighting strips set forth in FIGS. 2 and 3, a third lighting strip 50 is further coupled to lighting strip 30 by a junction housing 51. It will be apparent by comparing FIGS. 1 and 2 that this further coupling of a third lighting strip is obtained by removing end cap 40 and substituting junction housing 51. With the attachment of lighting strip 50 to lighting strip 30 at junction housing 51, an end cap 52 substantially identical to end cap 40 is secured to the remaining end of lighting strip 50 to complete the serial array of three lighting strips.

As described above, lighting strip 10 includes a base 11 supporting a retaining strap 14 having a flange 21 secured to base 11 by a plurality of fasteners 15. As is also described above, lighting strip 30 includes a retaining strap 32 having a flange 34 secured to a base 31 by a plurality of fasteners 35. As mentioned, lighting strip 50 is substantially identical to lighting strips 10 and 30 and thus need not be further described. The importance of lighting strip 50 in combination with lighting strips 10 and 30 is to provide an illustration of a plurality of lighting strips joined to form a linear array. It will be understood by those skilled in the art that a virtually endless variety of combinations of lighting strips may be utilized in accordance with the present invention without departing from the spirit and scope thereof.

Figure 3:
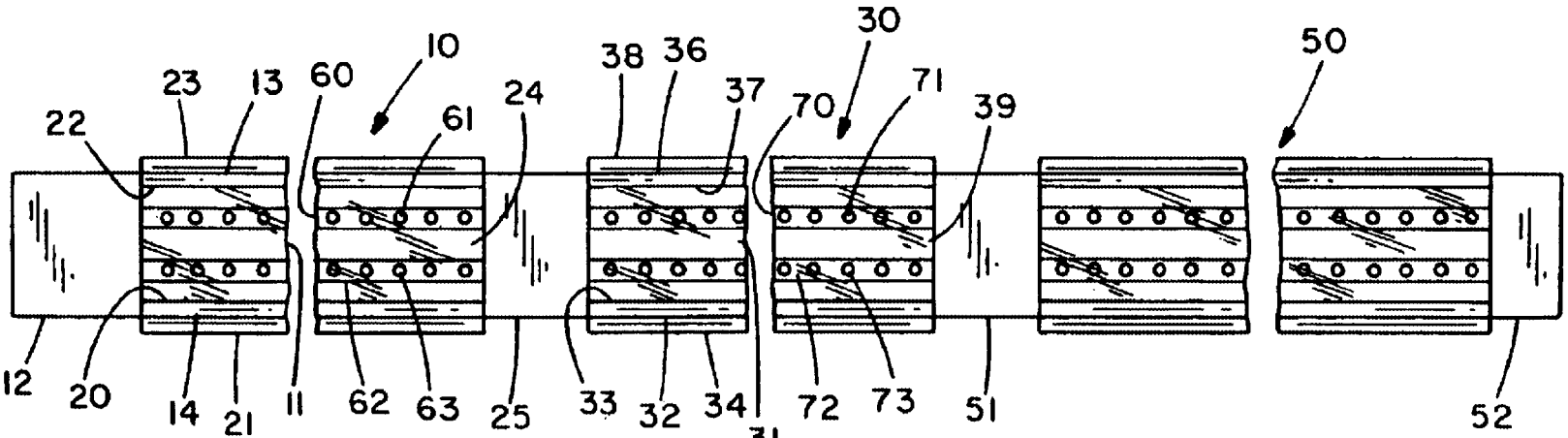
FIG. 3 sets forth a top view of the plurality of lighting strips for direction and guidance systems set forth in FIG. 2.

FIG. 3 sets forth a top view of the lighting strip combination of lighting strips 10, 30 and 50 set forth above in FIG. 2. As described therein, lighting strip 10 is coupled to a terminal housing 12 and a junction housing 25. As is also described above, lighting strip 30 is coupled to junction housing 25 and junction housing 51. Finally, lighting strip 50 is coupled to lighting strip 30 at junction housing 51 and further supports an end cap 52.

Lighting strip 10 includes a base 11 supporting a pair of retaining straps 13 and 14. Strap 13 includes an outwardly extending flange 21 and an inwardly extending lip 20. Similarly, retaining strap 13 includes an inwardly extending lip 22 and an outwardly extending flange 23. Base 11 of lighting strip 10 further supports a pair of LED strips 60 and 62 in a generally parallel spaced apart arrangement. LED strips 60 and 62 are set forth below in FIG. 4 in greater detail. However, suffice it to note here that LED strip 60 includes an elongated printed circuit board having a plurality of light emitting diodes 61 supported thereon. Similarly, LED strip 62 includes an elongated thin printed circuit board having a plurality of light emitting diodes 63 supported thereon. A top cover 24 formed of a light transmissive encapsulating material is formed upon the upper surface of base 11 in the manner shown in FIG. 4 to completely encapsulate and seal the light emitting diodes within lighting strip 10.

Lighting strip 30 is fabricated in the same manner as lighting strip 10 and thus includes a base 31 having an upper surface supporting a pair of parallel spaced apart light emitting diodes strips 70 and 72. Light emitting diode strip 70 includes an elongated thin printed circuit board supporting a plurality of light emitting diodes 71 while light emitting diode strip 72 includes an elongated thin printed circuit board supporting a plurality of light emitting diodes 73. Lighting strip 30 further includes retaining straps 32 and 36. Strap 32 includes an outwardly extending flange 34 and an inwardly extending lip 33. Similarly, retaining strap 36 includes an inwardly extending lip 37 and an outwardly extending flange 38. A top cover 39 is formed of a light transmissive encapsulating material which is formed upon the upper surface of base 31 to completely encapsulate and seal the light emitting diodes supported upon base 31.

Figure 5:
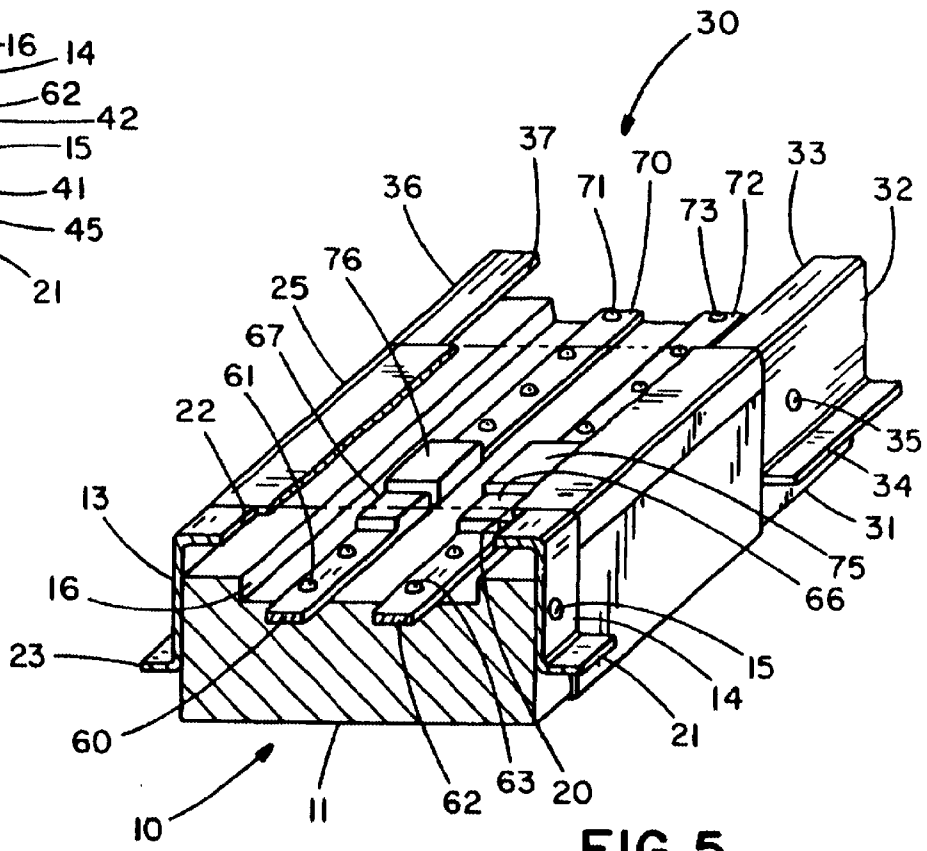
FIG. 5 sets forth a partial perspective view of a junction and connection of two lighting strips for direction and guidance system constructed in accordance with the present invention.

Lighting strip 50 is fabricated in substantial accordance with lighting strips 10 and 30 and is secured thereto at junction housing 51. Thus, lighting strip 50 supports a pair of spaced apart rows of light emitting diodes to correspond to the light emitting diodes in strips 10 and 30. Within junction housing 25, the structure set forth below in FIG. 5 provides electrical connection between LED strips 60 and 70 and between LED strips 62 and 72. Similarly, within junction housing 51 LED strips 70 and 72 are electrically coupled to the corresponding LED strips within lighting strip 50. In this manner, the controlling apparatus within terminal housing 12 (seen in FIG. 6) is capable of energizing the combined pluralities of light emitting diodes within lighting strips 10, 30 and 50 in the desired sequence and timing.

Figure 4:
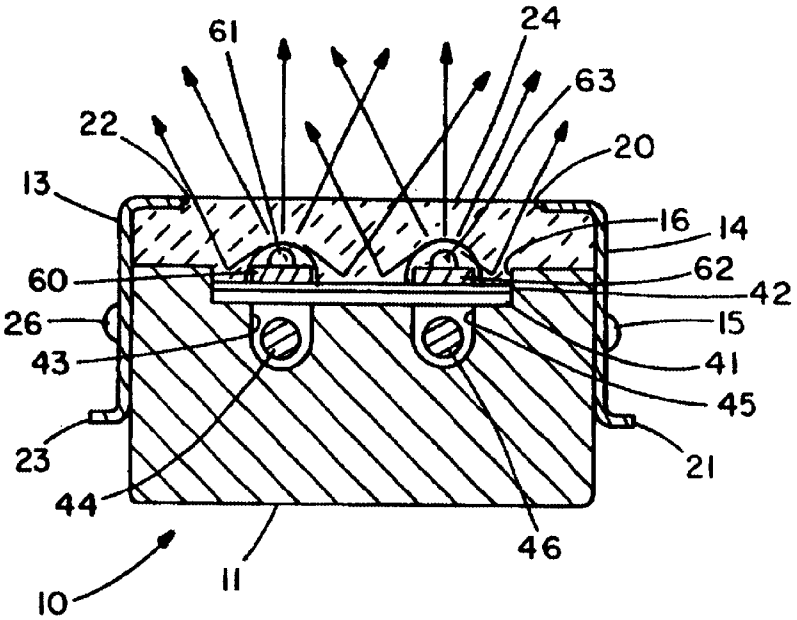
FIG. 4 sets forth a section view of the lighting strip set forth in FIG. 2 taken along section lines 4—4 therein.

FIG. 4 sets forth a section view of lighting strip 10 taken along section lines 4—4 in FIG. 2. Lighting strip 10 includes an elongated generally rectangular base 11 having an upper surface defining a channel 16. Within channel 16 a pair of cable grooves 43 and 45 are formed. A plurality of cables such as heat tracing cables 44 and 46 are positioned within grooves 43 and 45. The function of heat tracing cables 44 and 46 is utilized to determine the operative temperature of the light emitting diode arrays within the lighting strip to identify potential problems and control system operation. Lighting strip 10 further includes an elongated plate 41 preferably formed of a material such as aluminum or the like is received within channel 16 and extends virtually the entire length of base 11. A reflector layer 42 preferably formed of a light reflecting tape material or the like is supported upon the upper surface of aluminum plate 41. A pair of LED strips 60 and 62 having respective pluralities of LED's 61 and 63 supported thereon is positioned upon reflecting tape 42 within channel 16. A top cover 24 formed of a light transmissive encapsulating material is deposited and formed upon the upper surface of base 11 so-as-to seal and encapsulate LED strips 60 and 62 together with the pluralities of light emitting diodes 61 and 63 thereon. A pair of retaining straps 13 and 14 are secured to base 11 by conventional fasteners 26 and 15 respectively. Straps 13 and 14 function to maintain secure positioning and mechanical strength for top cover 24 upon the upper surface of base 11. Toward this end, strap 13 includes an inwardly extending lip 22 and an outwardly extending flange 23. Similarly, strap 14 includes an inwardly extending lip 20 and an outwardly extending flange 21. In particular, lips 20 and 22 substantially secure top cover 24 upon the upper surface of base 11 while outwardly extending flanges 21 and 23 provide positioning of the lighting strip within a pavement groove. In addition, flanges 21 and 23 allow the further enclosure of the lighting strip within a pavement groove by forming convenient gripping apparatus for a quantity of grout material which is used to further seal the lighting strip within a pavement groove.

In operation, as LED's 61 and 63 are energized they produce light output which, as is indicated by the arrows in FIG. 4, propagates outwardly through the light transmissive material of top cover 24. In addition, a significant amount of light energy produced by LED's 61 and 63 travels outwardly from the LED's in a less direct manner and impinges the reflective surface of reflector 42. In this event, the reflective qualities of surface 42 cause the reflection of this light energy outwardly through the light transmissive material of top cover 24 as indicated by the angled arrow representations in FIG. 4. The combined light output both directly propagating and reflected which leaves top cover 24 is then visible by persons near the lighting strip to provide visual guidance and direction information. It will be apparent to those skilled in the art that the use of differently colored LED's within the lighting strip may be employed to provide different colors of light viewed by persons in the vicinity of the lighting strip system. In addition, the color of visual light produced by the lighting strip may also be altered by tinting the light transmissive material of top cover 24.

FIG. 5 sets forth a partial perspective view of junction housing 25 and the attachment between lighting strips 10 and 30. It will be recalled that lighting strips 10 and 30 are electrically and mechanically coupled at junction housing 25.

More specifically, lighting strip 10 includes a base 11 having an end portion received within one side of a junction housing 25. Base 11 defines a channel 16 within which a pair of LED strips 60 and 62 support respective pluralities of LED's 61 and 63. Lighting strip 10 further includes a pair of retaining straps 13 and 14 secured to base 11 by conventional fasteners 15 and 26 (fasteners 26 seen in FIG. 4). Lighting strip 10 further includes a top cover 24 formed of a light transmissive encapsulating material. Retaining strap 13 includes an inwardly extending lip 22 and an outwardly extending flange 23. Retaining strap 14 includes an outwardly extending flange 21 and an inwardly extending lip 20.

Similarly, lighting strip 30 includes a base 31 having an end portion received within junction housing 25. By way of further similarity, lighting strip 30 includes a pair of LED strips 70 and 72 supporting pluralities of LED's 71 and 73 upon the upper surface of base 31. Lighting strip 30 further includes retaining straps 32 and 36 having respective inwardly extending lips 33 and 37. A top cover 39 is formed upon the upper surface of base 31 and comprises an encapsulating light transmissive material which encapsulates and seals LED strips 70 and 72 as well as LED's 71 and 73.

To facilitate electrical connection between the LED strips of lighting strip 10 and the LED strips of lighting strip 30, a plurality of conventional plug-in connectors are provided. More specifically, LED strip 60 supports a connector element 67 which cooperates with a connector element 76 supported upon LED strip 70. In this manner, electrical connect between LED strip and LED strip 70 is provided. Similarly, LED strip 62 supports a connector element 66 while LED strip 72 supports a cooperating connector element 75. This in turn facilitates electrical connection between LED strip 62 and LED strip 72. While not seen in FIG. 5, it will be understood that a corresponding electrical connection is provided between lighting strips 30 and 50 within junction housing 51 (seen in FIG. 3). It will be apparent to those skilled in the art that virtually any type of cooperating connector elements may be utilized to provide electrical connection between LED strips 60 and 62 and LED strips 70 and 72 without departing from the spirit and scope of the present invention. It will be further understood that such connecting elements are readily available within the art and need not be further described herein.

Figure 6:
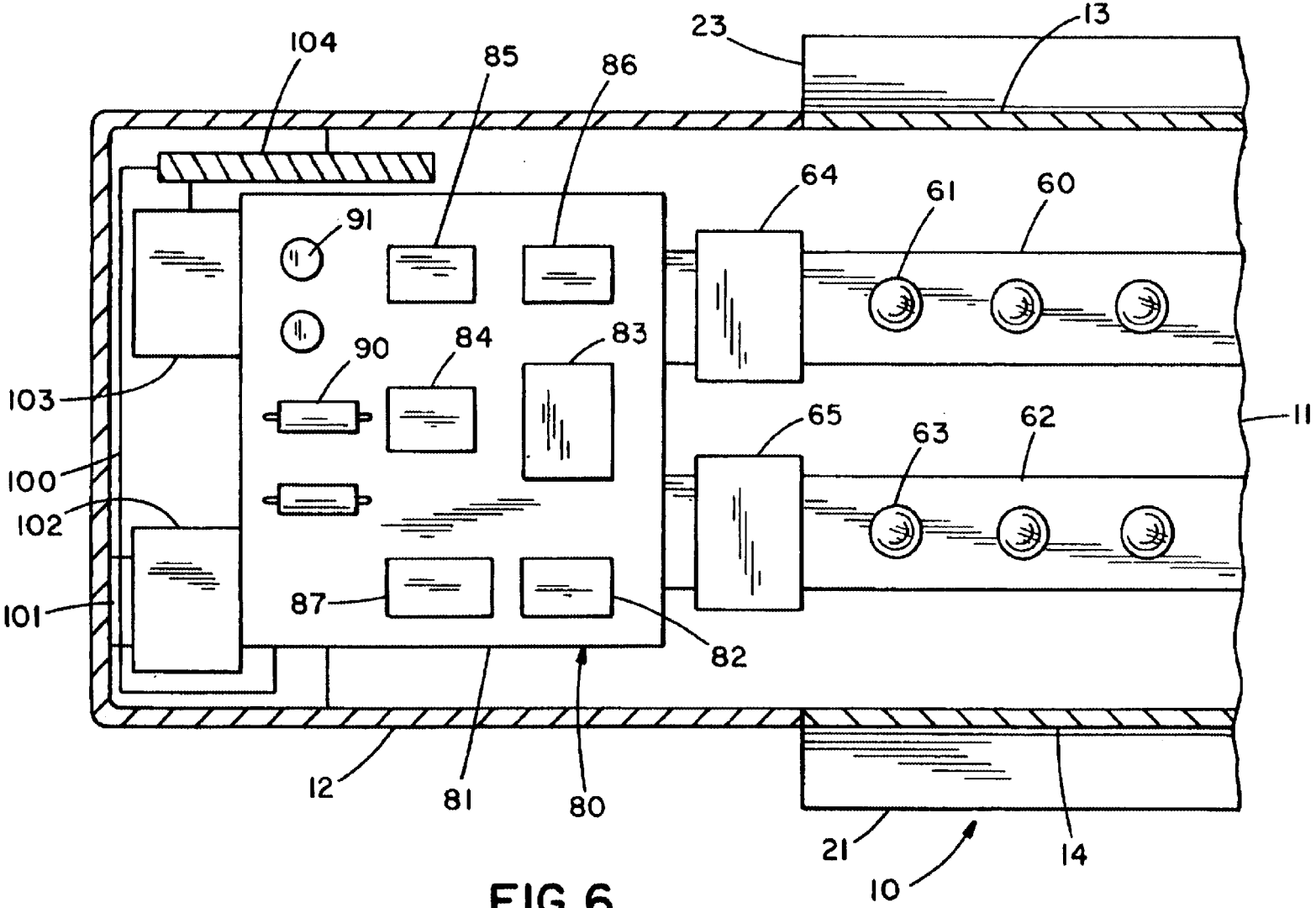
FIG. 6 sets forth a partial section view of the terminal box and control apparatus of the lighting strip for direction and guidance systems shown in FIG. 2 taken along section lines 6—6 therein.
Figure 7:
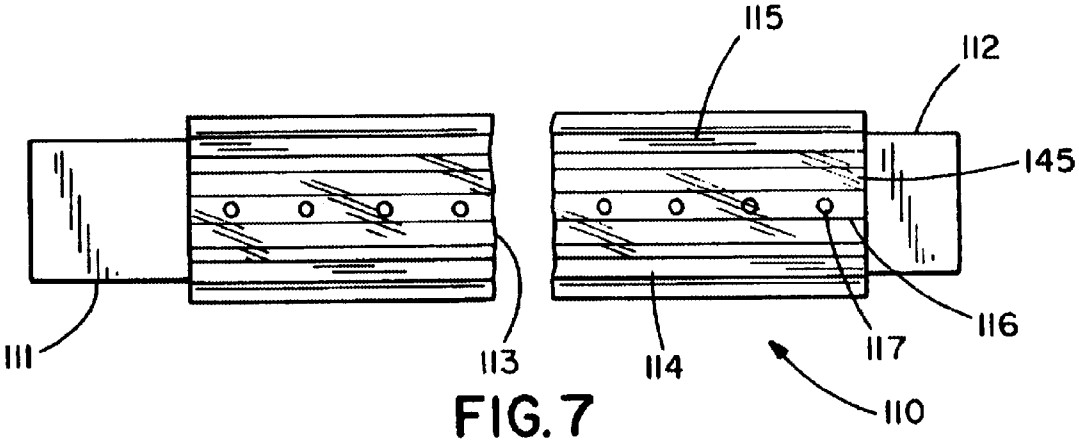
FIG. 7 sets forth a top view of an alternate embodiment of the present invention lighting strip for direction and guidance systems.

FIG. 6 sets forth a partial section view of lighting strip 10 taken along section lines 6—6 in FIG. 2. As described above, lighting strip 10 includes an elongated generally rectangular insulating base 11 supporting a pair of LED strips 60 and 62 on the upper surface thereof. LED strips 60 and 62 further support respective pluralities of LED's 61 and 63. As described above, lighting strip 10 includes a pair of retainer straps 13 and 14 secured to base 11 by convention fasteners. As is also described above, straps 13 and 14 include respective flanges 23 and 21. A pair of conventional connectors 64 and 65 are operatively coupled to LED strips 60 and 62 respectively. Connectors 64 and 65 may be fabricated entirely in accordance with conventional fabrication techniques and are operative to provide electrical connection to LED's 61 and 63.

Terminal housing 12 receives one end of base 11 and supports a power controller 100. Power controller 100 includes an AC/DC converter 102 fabricated in accordance with conventional fabrication techniques which may further include an external power input 101. Power controller 100 further includes a radio frequency controller 103 operatively coupled to converter 102. Radio controller frequency 103 is operatively coupled to a radio frequency antenna 104 and includes conventional circuit apparatus for receiving a control signal at antenna 104 and for providing output command signals in response thereto.

Terminal housing 12 further supports a light emitting diode controller 80 supported upon a conventional printed circuit board 81. LED controller 80 includes a microprocessor 84 and an associated memory 85. Memory 85 operates in accordance with conventional fabrication techniques to maintain a storage set of instructions which control the operation of microprocessor 84. A memory 86 also included within LED controller 80 is also operatively coupled to microprocessor 84 and provides functional memory for use by processor 84. An output power device 83 also supported upon printed circuit board 81 is operative in response to microprocessor 84 and is coupled to LED strips 60 and 62 to provide operating power for light emitting diodes 61 and 63. Additional circuit components such as components 90 and 91 are also supported upon printed circuit board 81.

In operation, LED controller 80 is able to function in a plurality of operating modes to control the illumination of LED's 61 and 63. For example, LED controller 80 is able to function in response to radio frequency command signals received by antenna 104 and coupled to radio frequency controller 103. These command signals are then converted by radio frequency controller 103 to appropriate input commands for microprocessor 84 which, in accordance with the stored instruction set within memory 85, configures and controls the operation of power circuits 83. Alternatively, LED controller 80 is able to function in direct control of converter 102 such that the stored instruction set within memory 85 causes microprocessor 84 to utilize the converted DC power output of converter 102 for direct application to power circuits 83. In either event, the end object sought is the desired illumination pattern and sequence for LED's 61 and 63. Thus, microprocessor 84 in alternative modes of operation may either illuminate LED's 61 and 63 in a steady state or alternate illumination therebetween. By way of further variation, LED's 61 and 63 may be operated in unison and blinked on and off at a desired repetition rate. Each of these modes of operation is readily available due to the stored instruction set within memory 85 of microprocessor 84.

FIG. 7 sets forth a top view of a further alternate embodiment of the present invention lighting strips for direction and guidance systems generally referenced by numeral 110. By way of overview, the primary difference between lighting strip 110 and lighting strips 10, 30 and 50 described above is the use of a single LED strip 116 rather than the parallel pair of LED strips set forth in the above embodiments. In all other respects, lighting strip 110 is substantially identical in structure and operation to lighting strips 10, 30 and 50 described above. Accordingly, lighting strip 110 includes an elongated generally rectangular insulated base 113 having a pair of retaining straps 114 and 115 secured thereto. Straps 114 and 115 are substantially identical to straps 14 and 13 set forth above. A terminal housing 111 and an end cap 112 are received upon base 113 and correspond substantially to terminal housing 12 and end cap 40 (seen in FIG. 1). Base 113 supports a single LED strip 116 having a plurality of LED's 117 supported thereby. A top cover 115 formed of a light transmissive encapsulating material is supported upon the upper surface of base 113 and provides encapsulation and sealing for LED strip 116 and LED' 117.

Figure 8:
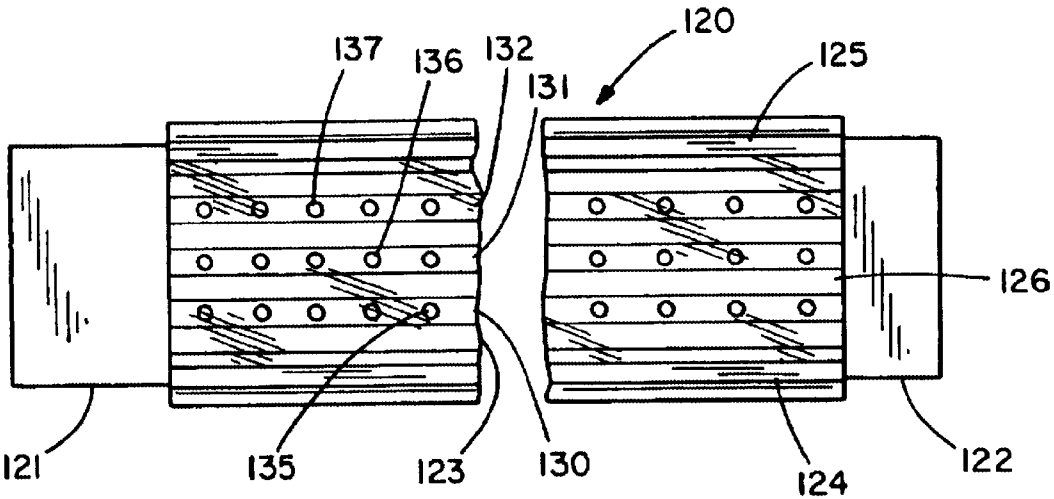
FIG. 8 sets forth a top view of a further alternate embodiment of the present invention lighting strip for direction and guidance systems.

FIG. 8 sets forth a top plan view of a still further alternate embodiment of the present invention lighting strip generally referenced by numeral 120. The primary difference between lighting strip 120 and lighting strip 10, 30 and 50 described above is the provision of a trio of parallel LED strips rather than the pair of LED strips utilized in lighting strips 10, 30 and 50. Thus, lighting strip 120 includes an elongated generally rectangular base 123 supporting a pair of retaining straps 124 and 125. A terminal housing 121 is joined to one end of lighting strip 120 while an end cap 122 is joined to the remaining end. A trio of LED strips 130, 131 and 132 is supported upon the upper surface of base 123. LED strips 130, 131 and 132 support respective pluralities of LED's 135, 136 and 137. A top cover 126 is formed upon the upper surface of base 123 and serves to encapsulate LED strips 130, 131 and 132 together with LED's 135, 136 and 137.

What has been shown in a lighting strip for direction and guidance system which utilizes high powered light emitting diodes in various array combinations to produce visual light in a manner which enhances the efficiency and safety of the host environments. The lighting strips may be coupled together to form more extended arrays or used in single strip applications. Embodiments are shown which employ a variety of light emitting diode arrangements upon the lighting strips to provide further variety of operation. The lighting strips are capable of operation in a host groove within a pavement such as an airport, taxiway or runway and are fabricated to sustain the impact and weight of vehicle traffic upon the lighting strip without damage.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A lighting strip for direction and guidance systems, said lighting strip comprising:

an elongated base formed of an insulating material and defining first and second ends, opposed sides and an upper surface;

at least one elongated strip supported upon said upper surface;

a first plurality of light emitting diodes supported on said at least one elongated strip;

a system for energizing said light emitting diodes supported at said first end;

a top cover formed of a light transmissive material encapsulating said upper surface, said elongated strip and said first plurality of light emitting diodes;

a light reflective surface formed on said upper surface;

said light emitting diodes producing visible light some of which travels outwardly through said top cover after being reflected from said light reflective surface; and said base defining multiple grooves for receiving and supporting a heat tracing cable and current carrying conductors.

2. The lighting strip set forth in claim 1 wherein said second end supports a connection which electrically and mechanically couples said lighting strip to a cooperating lighting strip.

3. The lighting strip set forth in claim 2 further including a pair of retaining straps secured to said opposed sides of each having an inwardly extending lip spaced above said upper surface and wherein said tip cover defines an upper surface extending between said lips.

4. The lighting strip set forth in claim 3 wherein said pair of retaining traps each include an outwardly extending flange.

5. The lighting strip set forth in claim 4 wherein said system for energizing includes a mechanism responsive to a radio frequency signal.

6. The lighting strip set forth in claim 1 wherein said system for energizing includes a mechanism responsive to a radio frequency signal.

7. The lighting strip set forth in claim 3 wherein said retaining straps can be electrically, mechanically and physically detached from one another and the lighting strip.

* * * * *